US007557687B2

(12) United States Patent
Watanabe

(10) Patent No.: US 7,557,687 B2
(45) Date of Patent: Jul. 7, 2009

(54) MAGNETIC CORE FOR ELECTROMAGNETIC APPARATUS AND ELECTROMAGNETIC APPARATUS PROVIDED WITH MAGNETIC CORE FOR ELECTROMAGNETIC APPARATUS

(75) Inventor: Osamu Watanabe, Saitama (JP)

(73) Assignee: Tamura Corporation, Tokyo (JP)

( * ) Notice: Subject to any disclaimer, the term of this patent is extended or adjusted under 35 U.S.C. 154(b) by 641 days.

(21) Appl. No.: 11/408,469

(22) Filed: Apr. 21, 2006

(65) Prior Publication Data

US 2006/0238288 A1 Oct. 26, 2006

(30) Foreign Application Priority Data

Apr. 22, 2005 (JP) ..... 2005-124772

(51) Int. Cl.
*H01F 27/24* (2006.01)

(52) U.S. Cl. ..... 336/234

(58) Field of Classification Search ..... 336/83, 336/212–215, 233–234
See application file for complete search history.

(56) References Cited

U.S. PATENT DOCUMENTS 2,145,703 A * 1/1939 Wirz ..... 336/160
6,829,817 B2 * 12/2004 Ngo et al. ..... 29/602.1

FOREIGN PATENT DOCUMENTS

JP S48-25123 A 4/1973
JP S53-162352 12/1978
JP 61-195022 12/1986
JP 63-078508 4/1988
JP H03-69212 7/1991
JP 10-294220 11/1998
JP 2002-134328 5/2002
JP 2004-047910 2/2004

* cited by examiner

*Primary Examiner*—Tuyen T. Nguyen
(74) *Attorney, Agent, or Firm*—Dennis G. LaPointe

(57) ABSTRACT

To provide a magnetic core for an electromagnetic apparatus and an electromagnetic apparatus provided with the magnetic core capable of reducing magnetic resistance, a magnetic core for an electromagnetic apparatus, having a middle leg section, having a first outer leg section and a second outer leg section which are arranged on each side of the middle leg section, having a first link section and a second link section respectively linking each side of the middle leg section, the first outer leg section and the second outer leg section, and having a first opening and a second opening located between the respective leg sections, the magnetic core comprising two cores which are joined with each other with a first abutting section extending through the middle leg section to insides of the first and second link sections, a second abutting section extending through the first outer leg section, and a third abutting section extending through the second outer leg section, in which the first abutting section consists mainly of a first rectilinear section extending obliquely from the inside of the first link section to the inside of the second link section, a second rectilinear section extending obliquely from one end of the first rectilinear section to the first opening, and a third rectilinear section extending obliquely from an other end of the first rectilinear section up to the second opening.

8 Claims, 16 Drawing Sheets
(4 of 16 Drawing Sheet(s) Filed in Color)

MAGNETIC CORE FOR ELECTROMAGNETIC APPARATUS AND ELECTROMAGNETIC APPARATUS PROVIDED WITH MAGNETIC CORE FOR ELECTROMAGNETIC APPARATUS

RELATED APPLICATIONS

This application claims priority from Japan Application Serial No. JP 2005-124772 filed 22 Apr. 2005.

BACKGROUND OF THE INVENTION

1. Field of the Invention

The present invention relates to a magnetic core for an electromagnetic apparatus to which a coil is to be mounted, and to an electromagnetic apparatus having the magnetic core therefor.

2. Description of the Related Art

As a magnetic core for an electromagnetic apparatus, there has been a type which is formed by an E-shaped core (E type core) and an I-shaped core (I type core), as shown in Japanese patent application laid open No. 2002-134328. As shown in FIG. 16, in the EI type core formed by these two cores, the I-shaped core 102 is fixed to the three leg sections of the E-shaped core 101. Then, a coil (not shown) is mounted around the middle leg section 101 A of the E-shaped core 101, to constitute an electromagnetic apparatus like a transformer or reactor, in which a coil is provided in the opening 103 of the EI type core.

However, as shown in FIG. 6, in the magnetic core for an electromagnetic apparatus of the above described structure, there is a problem that the magnetic resistance against the magnetic flux generated by the coil is high, making it hard for the magnetic flux to flow, because the junctions 104, 105 of the EI-shaped core have rectilinear shapes, with the two parts evenly facing each other, and the end face of the middle leg section 101 A is in contact. Further, as the unit to which the electromagnetic apparatus having said magnetic core is to be mounted becomes lighter and thinner, it is further demanded to lesson the heat generation of the magnetic core, to reduce the leakage of the magnetic flux, and so on. In other words, there is a demand for reducing the magnetic resistance of the magnetic core.

The present invention provides a magnetic core for an electromagnetic apparatus and an electromagnetic apparatus provided with the magnetic core for an electromagnetic apparatus capable of solving the above described problem and reducing magnetic resistance.

SUMMARY OF THE INVENTION

In order to solve the foregoing problems, the present invention provides a magnetic core for an electromagnetic apparatus, having a middle leg section, having a first outer leg section and a second outer leg section which are arranged on each side of the middle leg section, having a first link section and a second link section respectively linking each side of the middle leg section, the first outer leg section and the second outer leg section, and having a first opening and a second opening located between the respective leg sections, the magnetic core comprising two cores which are joined with each other with a first abutting section extending through the middle leg section to insides of the first and second link sections, a second abutting section extending through the first outer leg section, and a third abutting section extending through the second outer leg section; in which the first abutting section consists mainly of a first rectilinear section extending obliquely from the inside of the first link section to the inside of the second link section, a second rectilinear section extending obliquely from one end of the first rectilinear section and up to the first opening, and a third rectilinear section extending obliquely from an other end of the first rectilinear section and up to the second opening.

The present invention is characterized in that, in the above-mentioned magnetic core for an electromagnetic apparatus, the second abutting section extends outwardly and obliquely from a corner on the first link section side as well as on an outer side of the first opening and to an inside of the second link section, with an end part extending in a longitudinal direction of the second link section, while the third abutting section extends outwardly and obliquely from a corner on the second link section side as well as on an outer side of the second opening and to an inside of the first link section, with an end part extending in a longitudinal direction of the first link section.

The present invention is characterized in that, in the above-mentioned magnetic core for an electromagnetic apparatus, the two cores, which are on each side of the first abutting section, the second abutting section and the third abutting section, have a same shape.

The present invention provides an electromagnetic apparatus comprising an above-mentioned magnetic core for an electromagnetic apparatus.

According to the present invention, it is possible to reduce the magnetic resistance due to the abutting section of the middle leg section, since the abutting section cutting through the middle leg section extends to the insides of the first and second link sections, being inclined from the longitudinal direction of the middle leg section, with each end being bent in an L-shape and extending obliquely to the first or second opening, i.e., all sections of the first abutting section are inclined.

Further, extending the first abutting section, which passes through the middle leg section, to the first link section and the second link section and bending its end sections in an L-shape helps the magnetic flux to curve, which reduces the magnetic resistance.

According to the present invention, since the first outer leg section and the second outer leg section are provided with the second abutting section and the third abutting section which are inclined from the longitudinal direction of these outer leg sections, it is possible to reduce magnetic resistance of the first abutting section, the second abutting section and the third abutting section.

According to the present invention, since the two cores have a same shape, it is possible to reduce the number of parts used to produce the magnetic core for an electromagnetic apparatus.

According to the present invention, it is possible to realize an electromagnetic apparatus with a magnetic circuit having small magnetic resistance.

BRIEF DESCRIPTIONS OF THE DRAWINGS

The patent or application file contains at least one drawing executed in color. Copies of this patent with color drawing(s) will be provided by the Patent and Trademark Office upon request and payment of necessary fee.

DETAILED DESCRIPTION OF THE PREFERRED EMBODIMENTS

With reference now to the attached drawings, embodiments of the present invention will be explained in details below.

[Basic Mode]

Figure 1:
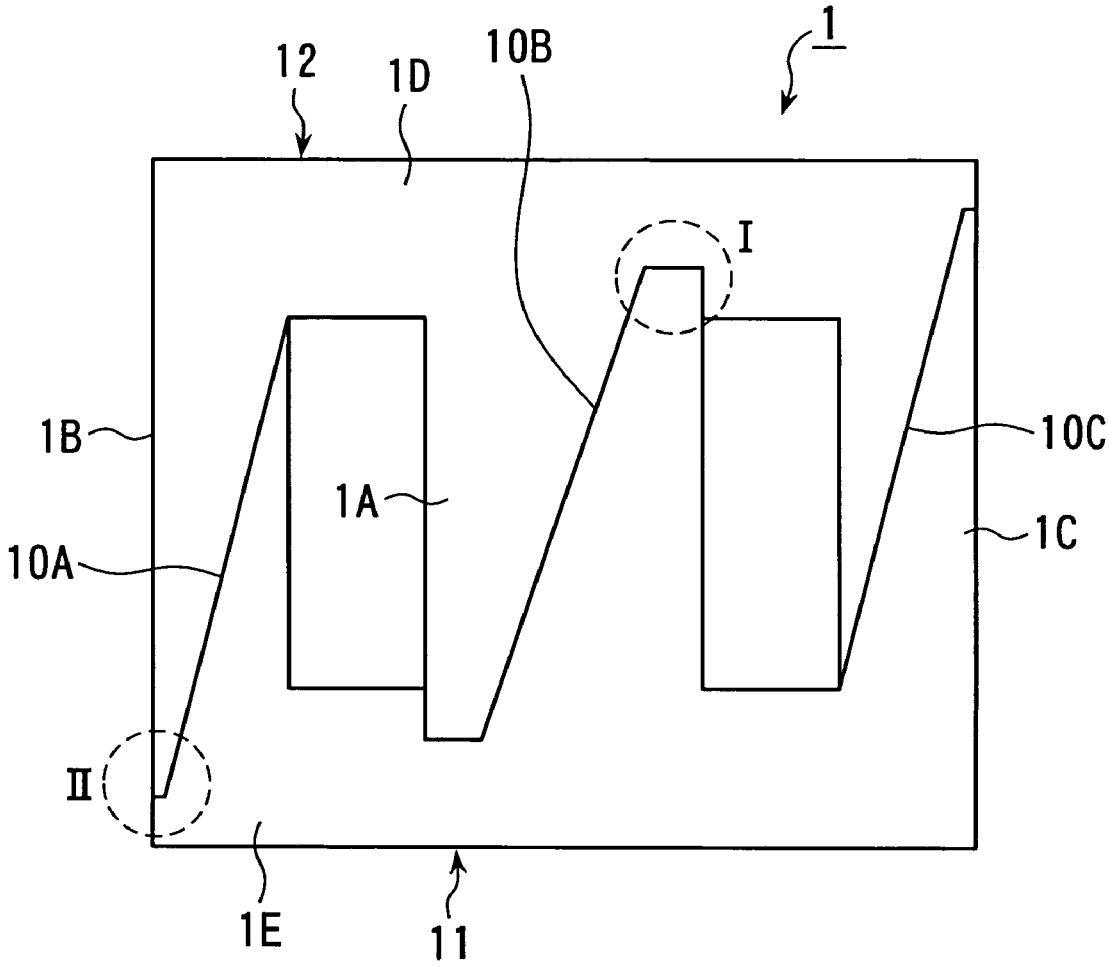
FIG. 1 is a plan view showing a magnetic core for an electromagnetic apparatus according to a basic mode.
Figure 2:
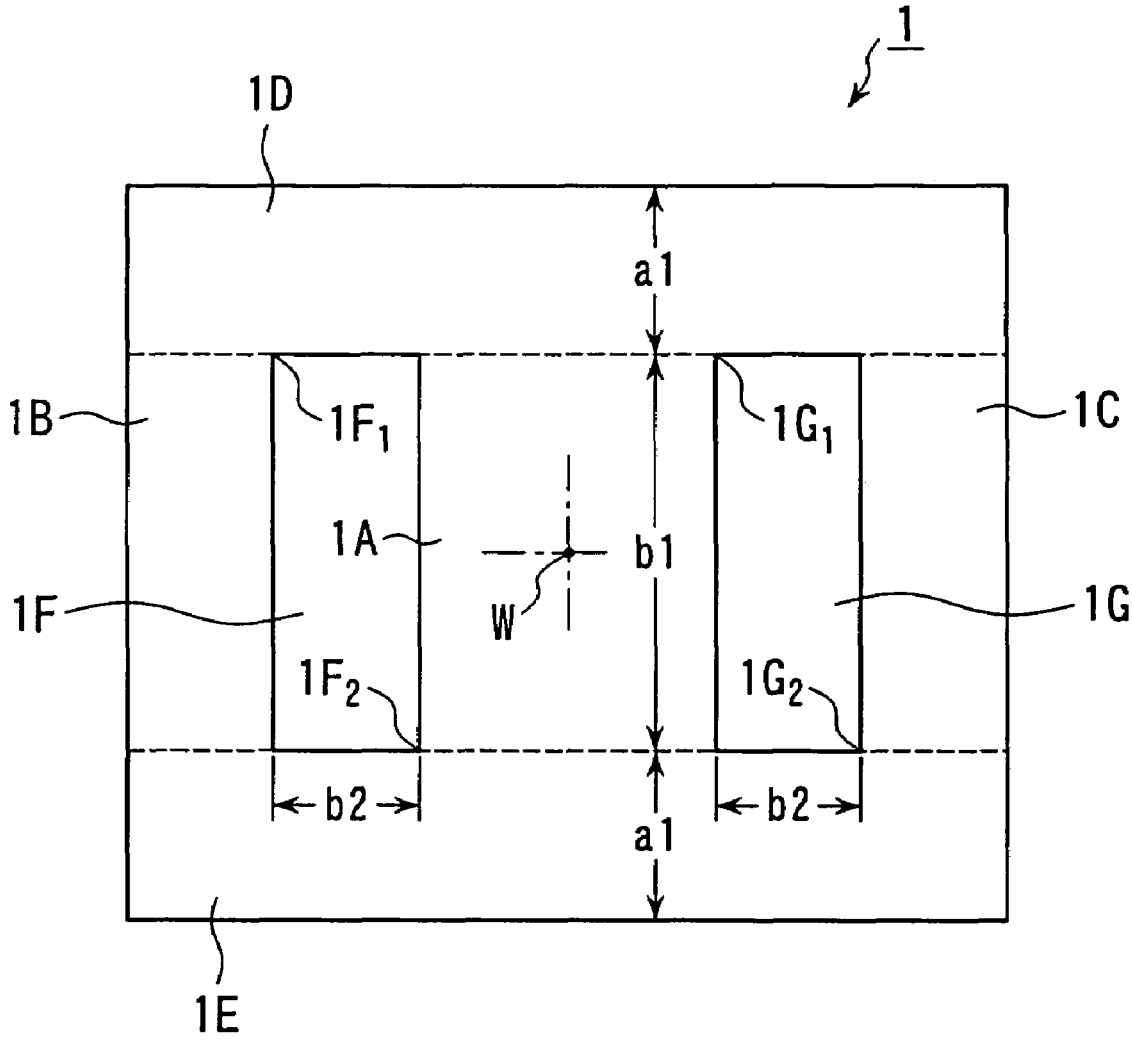
FIG. 2 is a plan view for explaining a magnetic core for an electromagnetic apparatus.
Figure 16:
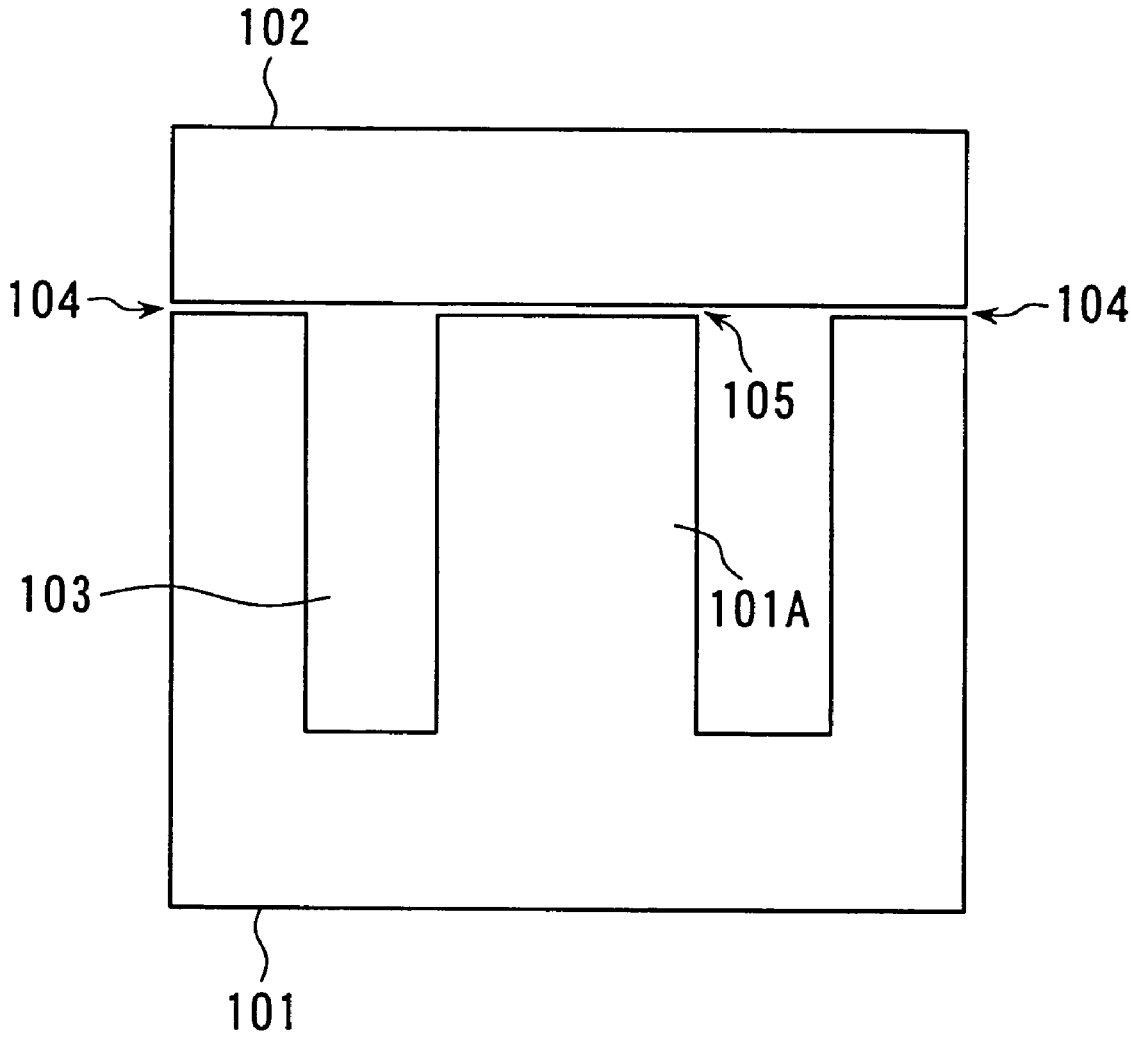
FIG. 16 is a plan view showing a conventional magnetic core for an electromagnetic apparatus.

FIG. 1 shows a basic configuration of the present invention. FIG. 1 shows a magnetic core which consists of two substantially E-shaped cores 11, 12 facing each other and combined into one body to basically form a magnetic core for an electromagnetic apparatus 1 as shown in FIG. 2. The magnetic core for an electromagnetic apparatus 1 in FIG. 2 is a laminated body of steel sheets. Viewed from the front, the whole combined body consists of a rectangular middle leg section 1A, a rectangular first outer leg section 1B and a second outer leg section 1C arranged on each side of the middle leg section 1A, and a rectangular first link section 1D and second link section 1E of width a1 which link the middle leg section 1A, first outer leg section 1B and the second outer leg section 1C respectively on each side. Furthermore, a rectangular first opening 1F and a second opening 1G having a length b1 and width b2 are also formed. As already known, a coil (not shown) is wound around the middle leg section 1A and the coil is disposed in the first opening 1F and second opening 1G. In the conventional technology, the middle leg section 1A, the first outer leg section 1B, the second outer leg section 1C and the second link section 1E constitute an E-shaped core and the first link section 1D constitutes an I-shaped core (see FIG. 16), but this basic mode adopts the following structure. This embodiment will be explained below using FIG. 2 as well.

When explained also using FIG. 2, the first outer leg section of the magnetic core for an electromagnetic apparatus in FIG. 1 is cut obliquely from a corner $1F_1$ on the outer side as well as the first link section 1D side of the first opening 1F, downwardly and outwardly as illustrated in the figure, to the inside of the second link section 1E, and the end of the cut is bent outward in the longitudinal direction of the second link section 1E. In this way, an abutting section 10A is formed with its most part inclined.

Further, the middle leg section 1A of the magnetic core for an electromagnetic apparatus in FIG. 1 is cut by an inclined straight line extending from the inside of the first link section 1D to the inside of the second link section 1E. Further, between a corner $1G_1$ of the second opening 1G and one end, located in the first link section 1D, of the inclined straight line, the abutting section is formed to be in a bending L-shape, while between a corner $1F_2$ of the first opening 1F and the other end, located in the second link section 1E, of the inclined straight line, the abutting section is formed to be in a bending L-shape. In other words, in the magnetic core for an electromagnetic apparatus shown in FIG. 1, the first link section 1D and the second link section 1E, as well as the middle leg section 1A, are cut by an abutting section 10B which is substantially in a S-shape formed of straight lines.

Also, the second outer leg section 1C of the magnetic core for an electromagnetic apparatus 1 in FIG. 1 is cut obliquely from a corner $1G_2$, which is the opposing corner of the corner $1G_1$ in the second opening 1G, to the inside of the first link section 1D, and at the end thereof it is cut by the line bent outward in the longitudinal direction of the first link section 1D. In other words, in the magnetic core for an electromagnetic apparatus in FIG. 1, the first link section 1D as well as the second outer leg section 1C is cut by an abutting section 10C, at least one part of which is inclined.

Figure 3:
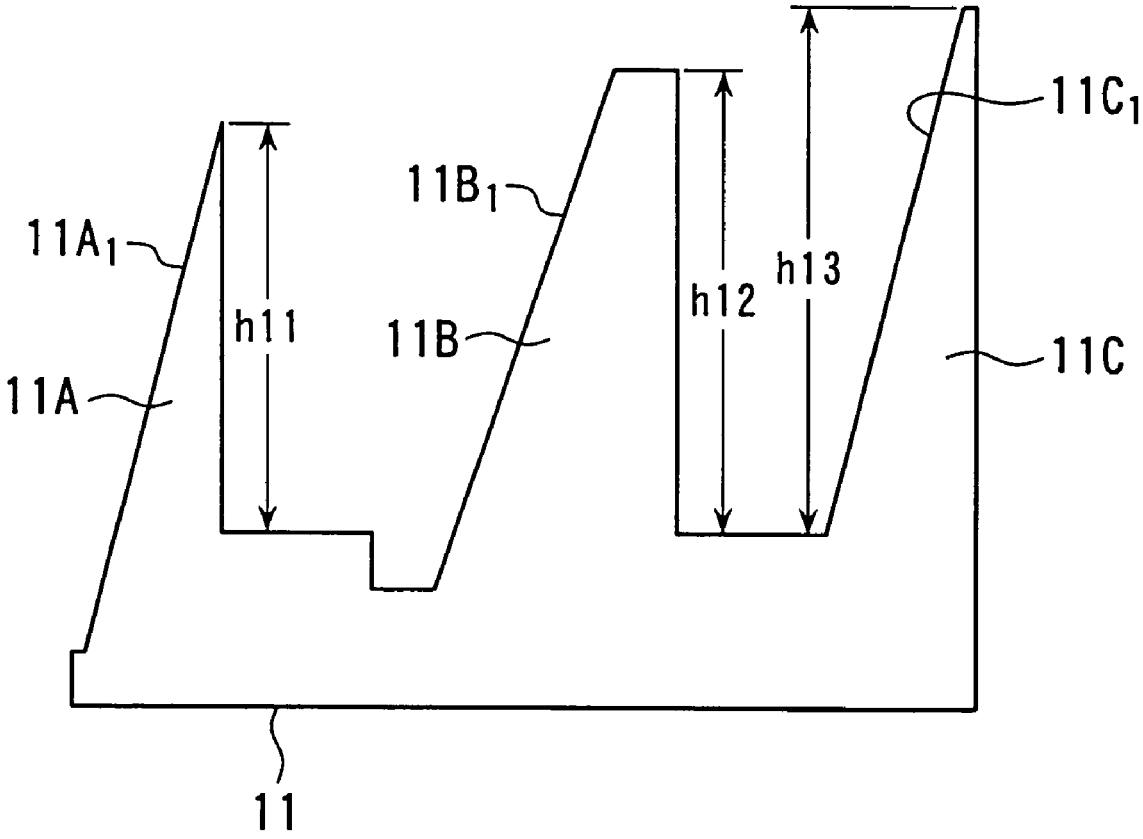
FIG. 3 is a plan view showing a substantially E-shaped core according to the basic mode.

As shown above, the magnetic core for an electromagnetic apparatus 1 is formed of substantially E-shaped cores 11, 12 located on each side of the abutting section 10A and abutting section 10C, which are at least partially inclined, and the substantially S-shaped abutting section 10B. That is, as shown in FIG. 3, the substantially E-shaped core 11 has tapering protrusions 11A to 11C. The length h11 from the inner side of the second link section 1E (see FIG. 2) to the end of the protrusion 11A, which is part of the first outer leg section 1B, is same with the length b1 of the first opening 1F. The protrusion 11B, which includes a part of the middle leg section 1A, has a length h12 longer than the length b1 of the second opening 1G and the end of the protrusion 11B extends into the width a1 of the first link section 1D. The length h13 from the inner side of the second link section 1E to the end of the protrusion 11C which includes a part of the second outer leg section 1C, is longer than the length b1 of the second opening 1G and the end of the protrusion 11C extends into the width a1 of the first link section 1D. Further, in this basic mode, the abutting section 10A, abutting section 10B and abutting section 10C are provided in such a way that the substantially E-shaped core 12 and the substantially E-shaped core 11 making up the magnetic core for an electromagnetic apparatus 1 have a same shape, and the two E-shaped cores of the same shape are arranged to face each other and joined together. That is, the substantially E-shaped core 11 and the substantially E-shaped core 12 are arranged to be symmetric with respect to the center w (see FIG. 2) of the magnetic core for an electromagnetic apparatus 1. In this embodiment, the center w is also the center of the middle leg section 1A.

Figure 4:
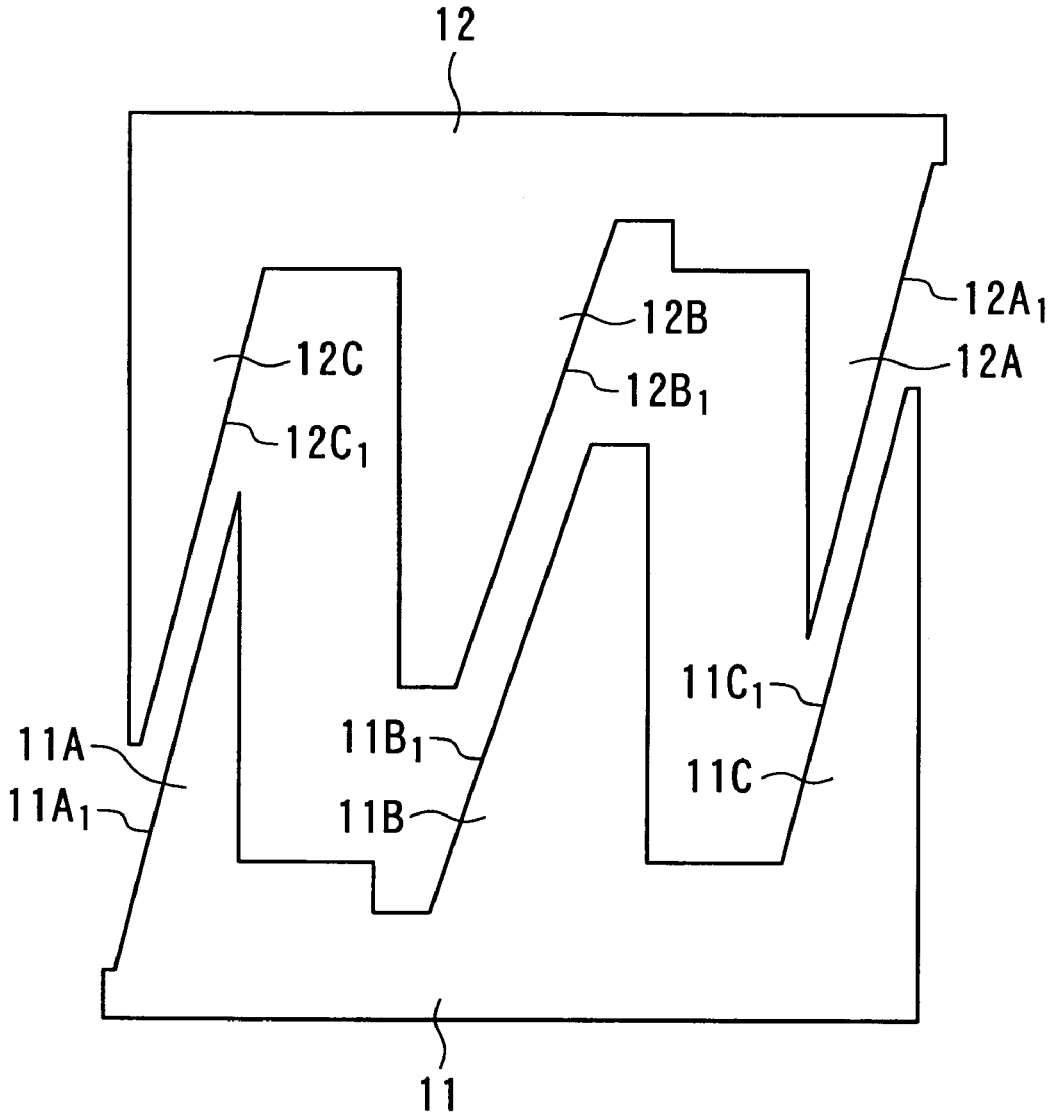
FIG. 4 is a plan view showing a combination of two substantially E-shaped cores.

In this basic mode, the magnetic core for an electromagnetic apparatus is made as follows, using the substantially E-shaped cores 11, 12 of the same shape. As shown in FIG. 4, the substantially E-shaped core 11 and the substantially E-shaped core 12 are arranged with their respective inside parts facing each other. As mentioned above, the substantially E-shaped core 11 and the substantially E-shaped core 12 have substantially the same shape, the hypotenuse $11A_1$ of the protrusion 11A of the substantially E-shaped core 11 corresponds to the hypotenuse $12A_1$ of the protrusion 12A of the substantially E-shaped core 12, the hypotenuse $11B_1$ of the protrusion 11B of the substantially E-shaped core 11 corresponds to the hypotenuse $12B_1$ of the protrusion 12B of the substantially E-shaped core 12 and the hypotenuse $11C_1$ of the protrusion 11C of the substantially E-shaped core 11 corresponds to the hypotenuse $12C_1$ of the protrusion 12C of the substantially E-shaped core 12.

Then, the protrusions 12C to 12A of the substantially E-shaped core 12 are arranged so as to face the protrusions 11A to 11C respectively corresponding to parts of the first outer leg section, the middle leg section and the second outer leg section of the substantially E-shaped core 11. That is, the hypotenuse $12C_1$ of the protrusion 12C of the substantially E-shaped core 12 is arranged to face the hypotenuse $11A_1$ of the protrusion 11A of the substantially E-shaped core 11, the hypotenuse $12B_1$ of the protrusion 12B of the substantially E-shaped core 12 is arranged to face the hypotenuse $11B_1$ of the protrusion 11B of the substantially E-shaped core 11, and the hypotenuse $12A_1$ of the protrusion 12A of the substantially E-shaped core 12 is arranged to face the hypotenuse $11C_1$ of the protrusion 11C of the substantially E-shaped core 11. Then, the substantially E-shaped core 11 is joined with the substantially E-shaped core 12 to form the magnetic core for an electromagnetic apparatus shown in FIG. 1 and FIG. 2.

Figure 5A:
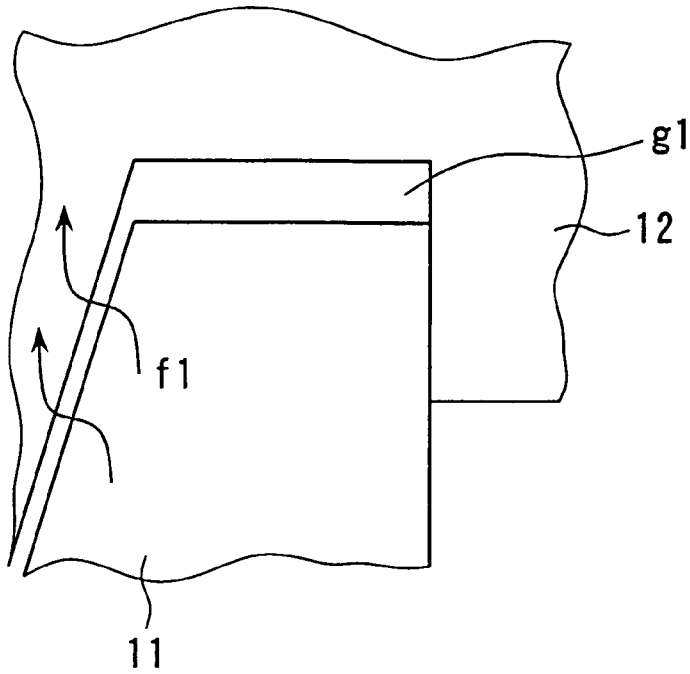
FIG. 5A is an enlarged view of part I in FIG. 1.
Figure 5B:
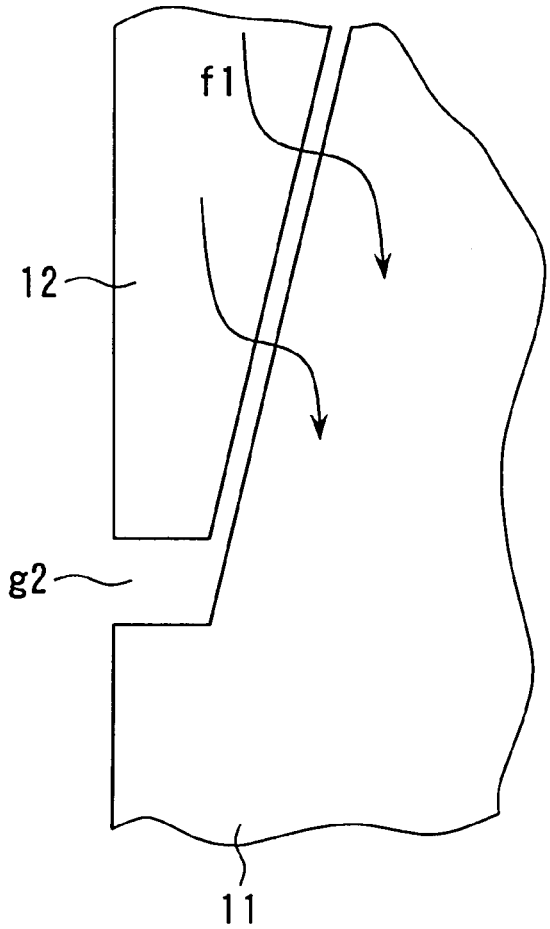
FIG. 5B is an enlarged view of part II in FIG. 1.

According to this magnetic core for an electromagnetic apparatus, even if gaps g1, g2 as shown in FIG. 5A and FIG. 5B occur during the assembling, the widths of the inclined gaps between the substantially E-shaped core 11 and the substantially E-shaped core 12 formed by the hypotenuses are narrower than the corresponding gaps g1, g2. FIG. 5A is an enlarged view of part I in FIG. 1 and FIG. 5B is an enlarged view of part II in FIG. 1. Thus, it is possible to narrow the widths of the respective inclined gaps formed of the hypotenuses of the substantially E-shaped cores 11, 12 and when magnetic fluxes flow through these inclined gaps, the magnetic fluxes flow in the direction indicated by arrows f1 in FIGS. 5A and 5B. That is, since the magnetic flux flows across the shortest distance of an inclined gap (distance in the direction perpendicular to the longitudinal direction of an inclined gap), it is possible to reduce magnetic resistance. Moreover, since the middle leg section 1A, first outer leg section 1B and the second outer leg section 1C are cut obliquely, these inclined gaps are elongated, which makes the magnetic fluxes that pass through these inclined gaps sparse. This can further reduce magnetic resistance.

Figure 6:
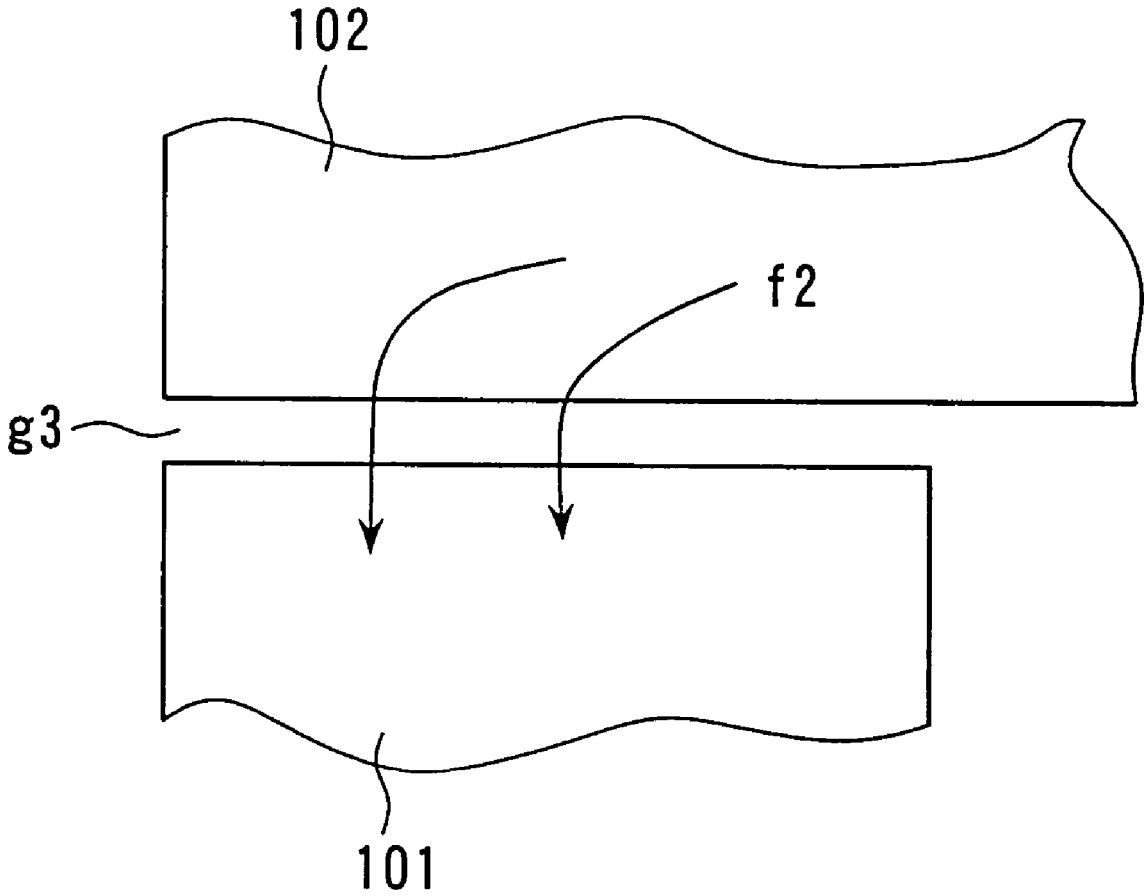
FIG. 6 is an enlarged partial view illustrating a flow of magnetic flux of a conventional magnetic core for an electromagnetic apparatus.

On the other hand, when the conventional E-shaped core 101 (FIG. 16) and I-shaped core 102 are used, the width of a gap g3, as shown in FIG. 6, is uniform throughout the junction. Furthermore, since a magnetic flux (arrow f2) that flows through the conventional magnetic core for an electromagnetic apparatus flows between the end faces having narrow widths of the respective leg sections of the E-shaped core 101, the magnetic flux becomes dense. Thus, the magnetic resistance of the conventional magnetic core for an electromagnetic apparatus is increased. On the contrary, this basic mode can reduce the widths of the gaps on the middle leg section 1A, the first outer leg section 1B and the second outer leg section 1C, and further make the lengths of the gaps longer than the lengths of the junctions in the conventional magnetic core for an electromagnetic apparatus, and can thereby reduce the magnetic resistance drastically compared to the conventional magnetic core for an electromagnetic apparatus.

Further, according to this basic mode, extending the substantially S-shaped abutting section 10B into the first link section 1D and the second link section 1E allows the magnetic flux passing through the middle leg section 1A being the principal magnetic path, to bend easily, by which the magnetic resistance can be reduced.

Figure 7:
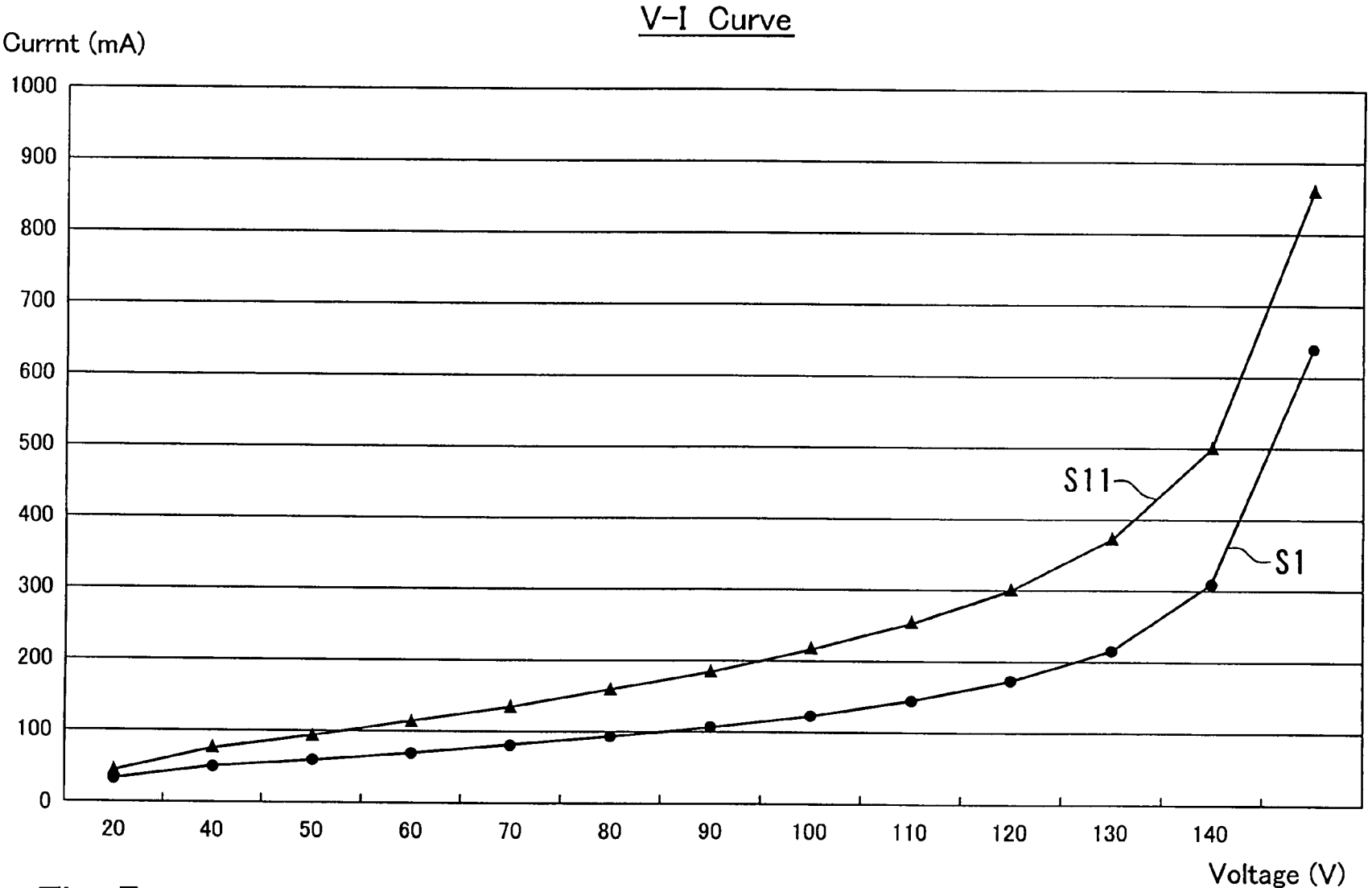
FIG. 7 illustrates excitation characteristics.
Figure 8:
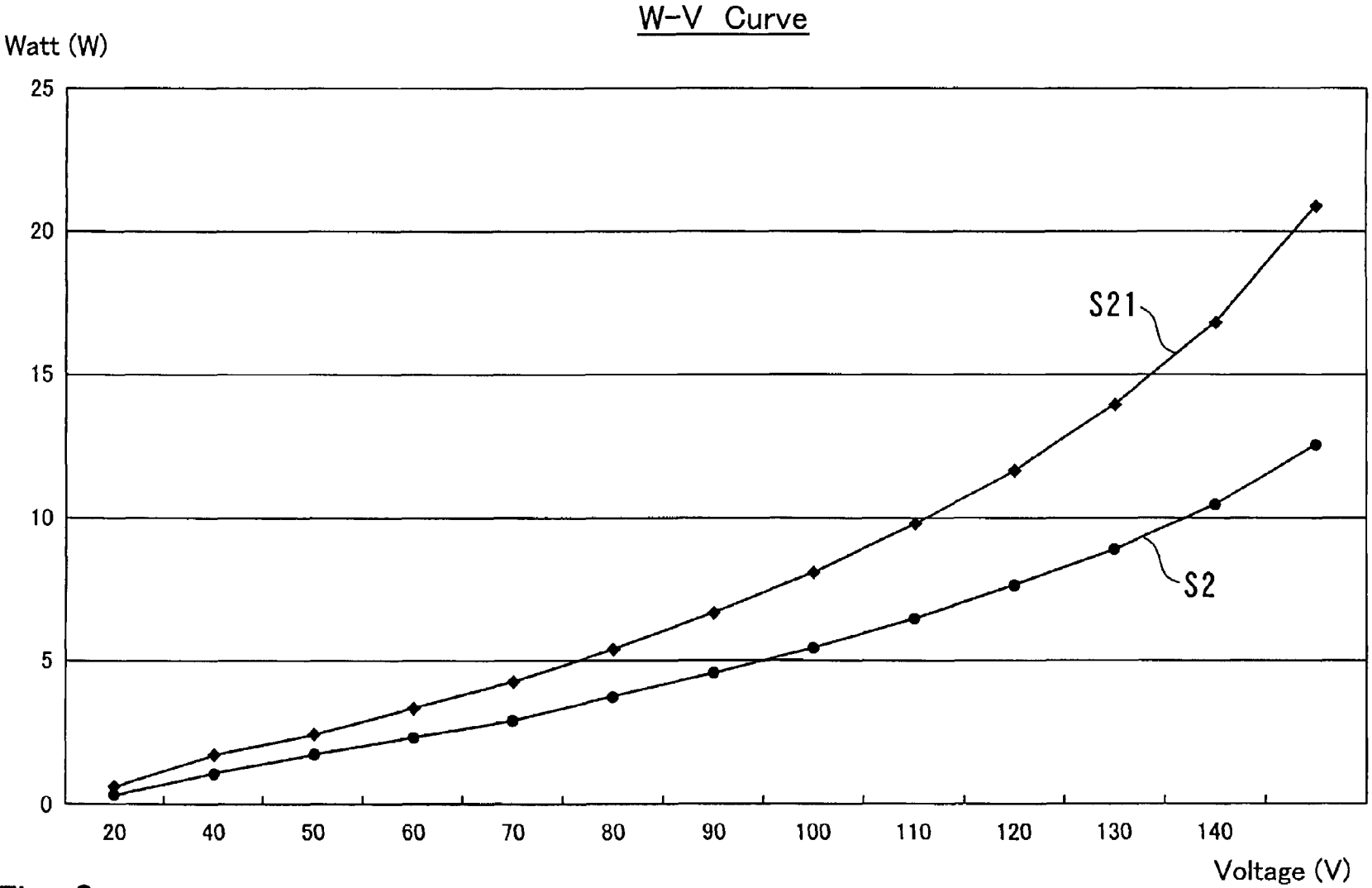
FIG. 8 illustrates iron losses.
Figure 9:
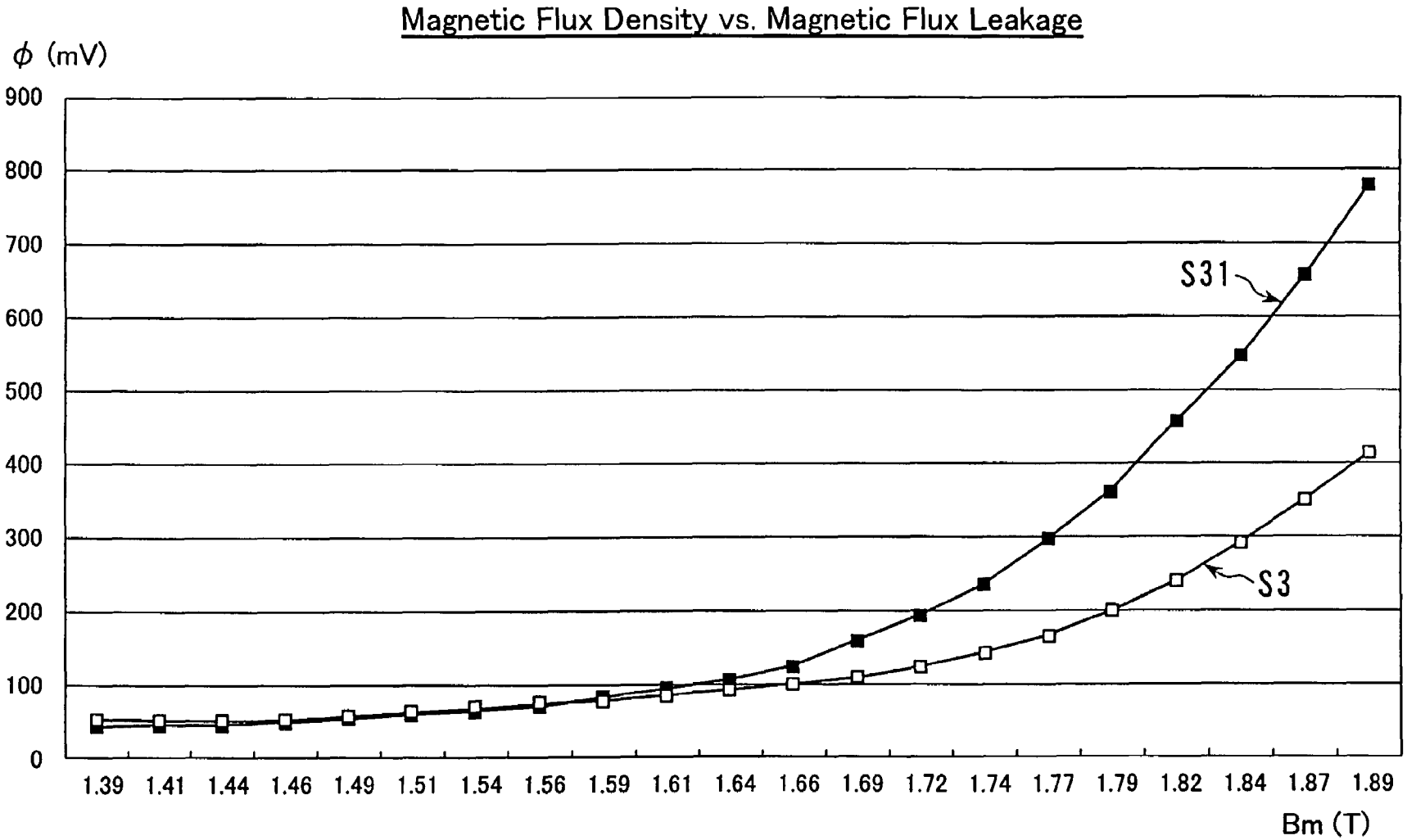
FIG. 9 illustrates magnetic flux leakages.

Moreover, as shown in the excitation characteristic in FIG. 7, the magnetic core for an electromagnetic apparatus according to this basic mode shows a better characteristic (curve S1) than the characteristic (curve S11) of the conventional magnetic core for an electromagnetic apparatus. Furthermore, in the characteristics indicating iron losses in FIG. 8, the magnetic core for an electromagnetic apparatus of this basic mode can reduce iron loss (curve S2) compared to conventional iron loss (curve S21). Furthermore, in the characteristic indicating magnetic flux leakage in FIG. 9, the magnetic core for an electromagnetic apparatus of this basic mode can reduce a magnetic flux leakage (curve S3) compared to a conventional magnetic flux leakage (curve S31). That is, according to this basic mode, it is possible to drastically improve the characteristics of the magnetic core for an electromagnetic apparatus.

Figure 10:
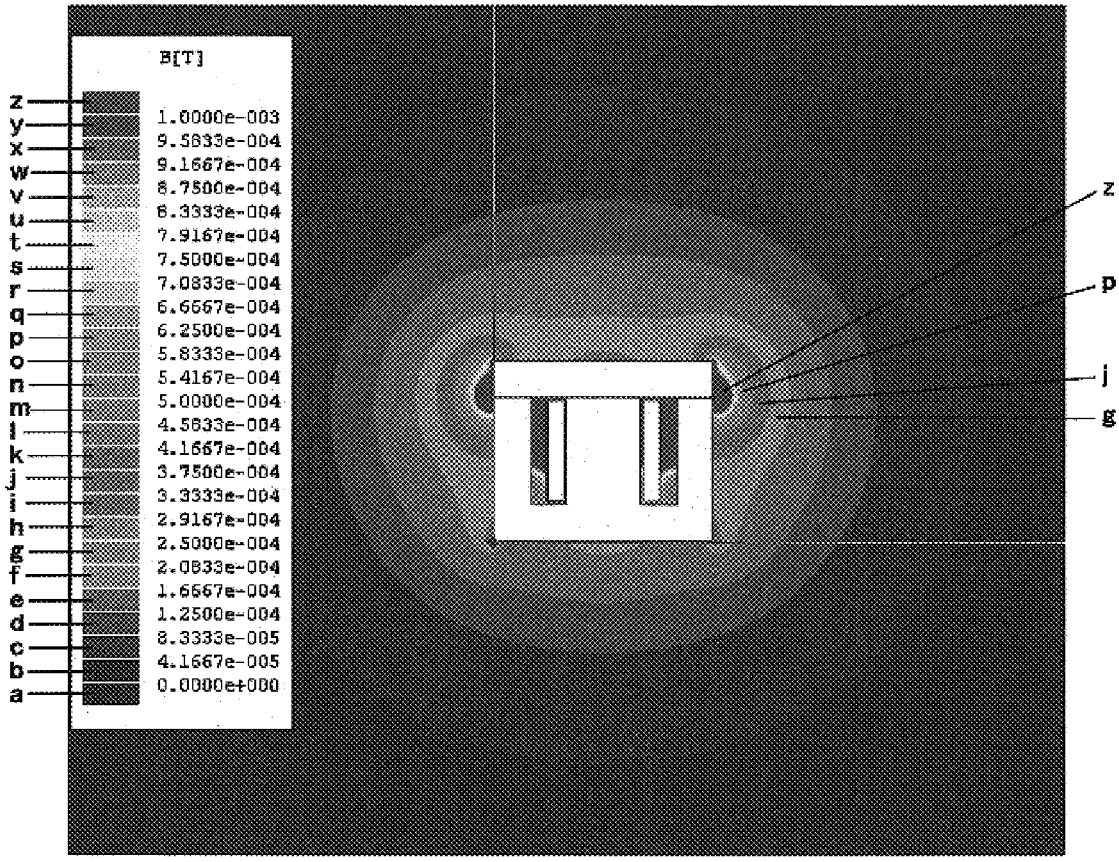
FIG. 10 illustrates an analysis result of the magnetic flux leakage of a conventional product using a finite-element method.
Figure 11:
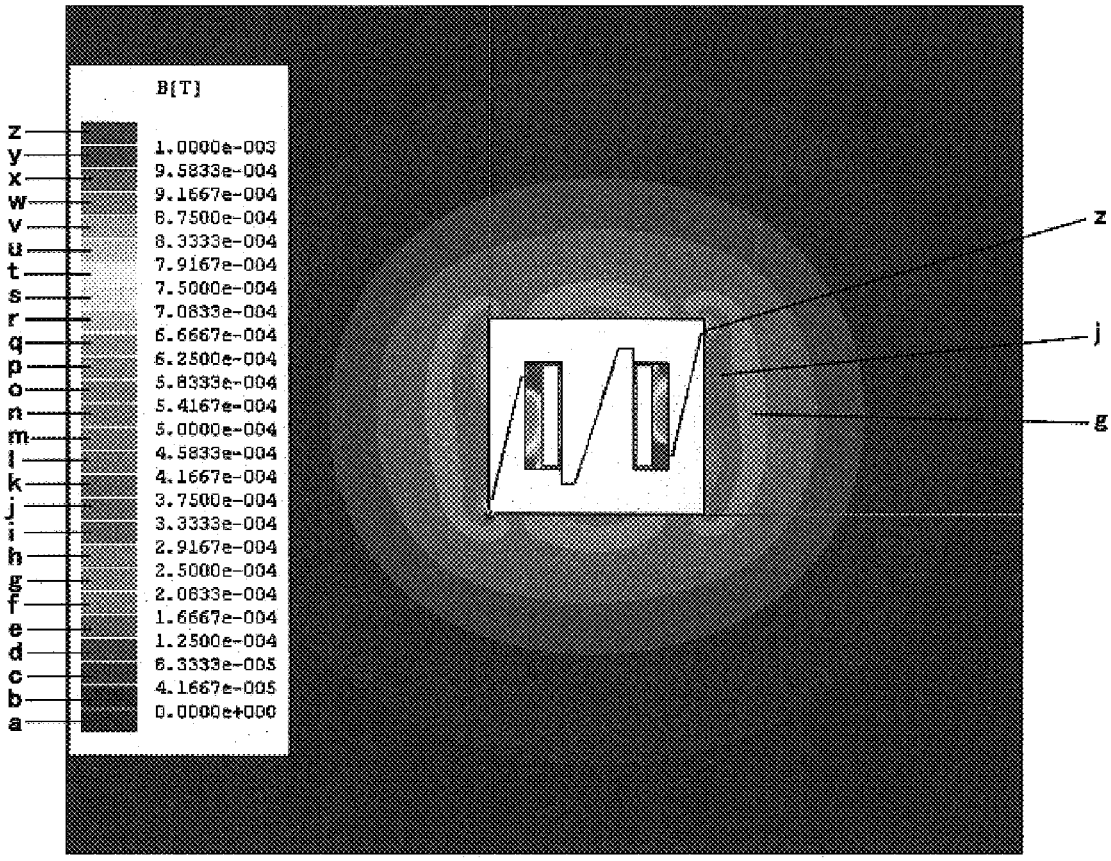
FIG. 11 illustrates an analysis result of the magnetic flux leakage of the product of the present invention using a finite-element method.

That is, FIG. 10 shows an analysis result of the magnetic flux leakage of the conventional product (shown in FIG. 16) using a finite-element method, while FIG. 11 shows the product of the basic mode shown in FIG. 1. Both are the analysis results with the coil wound around the middle leg section of 700 AT. Here, "AT" refers to a unit of the current flowing into the coil×number of turns. In these figures, a magnetic flux density increases from blue color a (symbol 0. 0000e+000) to red color z (symbol 1. 0000e−003). In the conventional example shown in FIG. 10, the outside area of the junction between the E-shaped core 101 and the I-shaped core 102 exhibits quasi-red z (symbol 1. 0000e−003), indicating that there is a larger area of red color z, while surrounding areas exhibit green p, light green j and sky blue g, indicating greater magnetic flux leakages.

On the contrary, the product of the basic mode shown in FIG. 11 shows that only one point corresponding to the junction between the substantially E-shaped cores 11, 12 slightly exhibits quasi-red color z, while surrounding areas exhibit light green j and sky blue g, indicating that the magnetic flux leakage is reduced.

Figure 12:
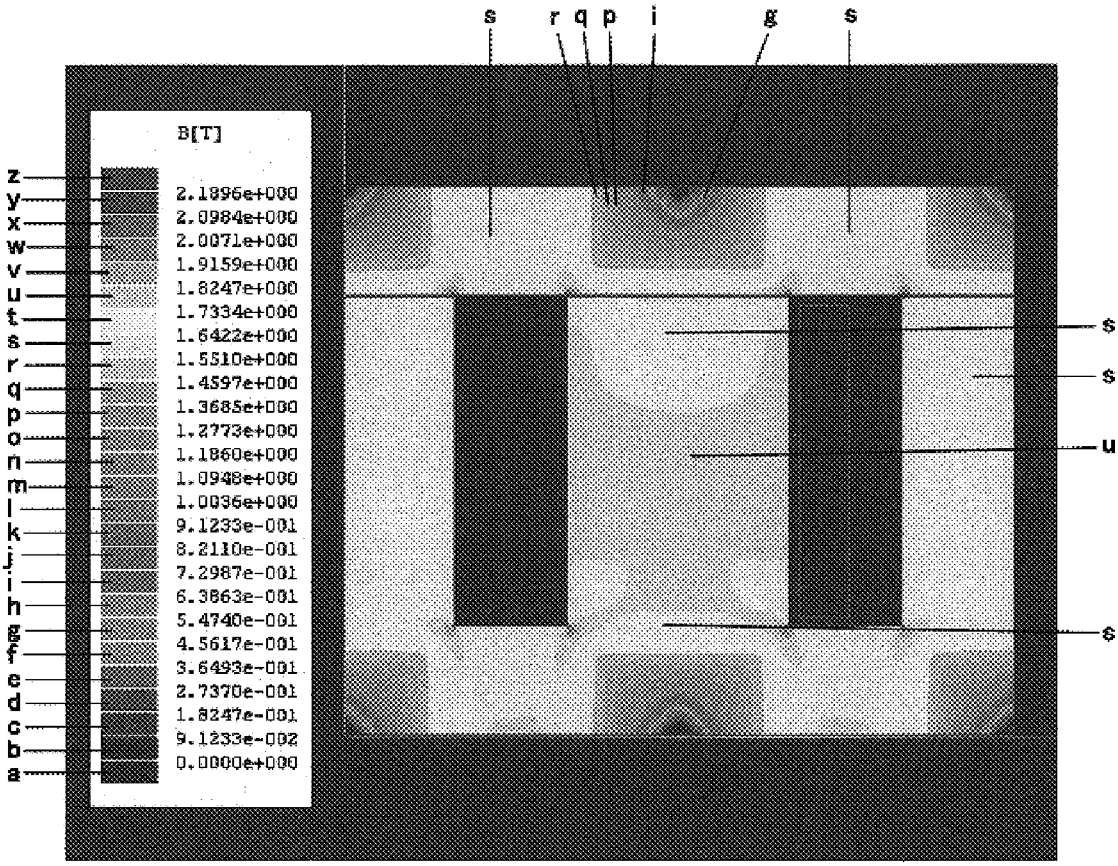
FIG. 12 illustrates an analysis result of a magnetic flux density distribution in the magnetic core of the conventional product using a finite-element method.
Figure 13:
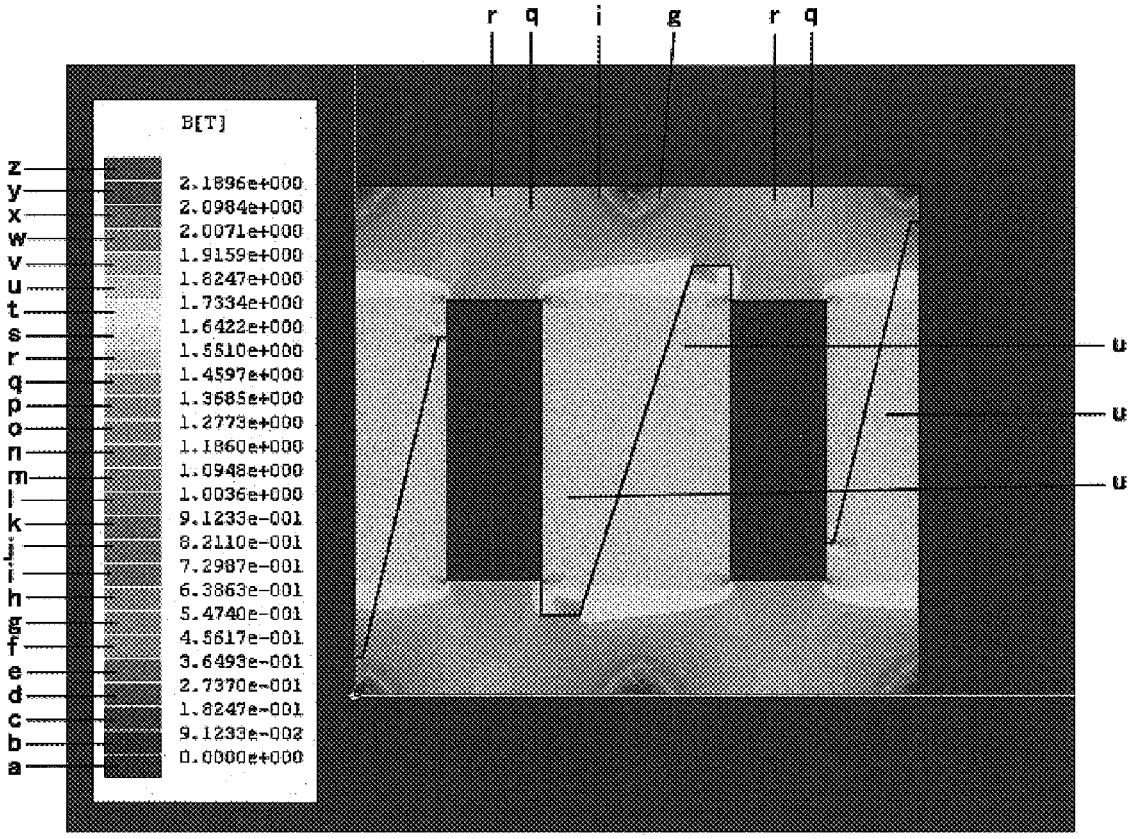
FIG. 13 illustrates an analysis result of a magnetic flux density distribution in the magnetic core of the present invention using a finite-element method.

Further, FIG. 12 shows a magnetic flux density distribution in the E-shaped core 101 and I-shaped core 102 of the conventional product, while FIG. 13 shows a magnetic flux density distribution of the product of the basic mode when AT is 44 AT for both.

The conventional product in FIG. 12 shows that the central part of the middle leg section exhibits khaki color u (symbol 1. 8247e+000 to 1. 7334e+000) and its outer sides exhibit dark yellow color s (symbol 1. 6422e+000 to 1. 5510e+000) respectively Furthermore, the outer leg sections exhibit dark yellow color s. Furthermore, the central part of the I-shaped core 102 and both sides thereof exhibit rectangular quasi-green color r to i (symbol 1. 5510e+000 to 6. 3863e−001) and the section therebetween exhibits dark yellow color s (symbol 1. 6422e+000 to 1. 5510e+000). In the conventional product, the magnetic flux density distribution is uneven.

On the contrary, the product of the basic mode shown in FIG. 13 shows that the middle leg section and outer leg sections globally exhibit khaki color u (symbol 1. 8247e+000 to 1. 7334e+000). Furthermore, the link sections above and below those sections globally exhibit quasi-green color r to i (symbol 1. 5510e+000 to 6. 3863e−001). Thus, the magnetic flux density distribution is substantially uniform, and the characteristics of the magnetic core for an electromagnetic apparatus are improved.

Further, since the substantially E-shaped core 11 and the substantially E-shaped core 12 have a substantially same shape, this basic mode can reduce the number of parts used to produce the magnetic core for an electromagnetic apparatus.

By mounting a coil (not shown) on the magnetic core for an electromagnetic apparatus, and so on, an electromagnetic apparatus can be assembled. In this electromagnetic apparatus, since the magnetic resistance of the magnetic circuit is smaller, a magnetic flux flows more easily, an excitation current and magnetic strains are reduced and also vibration and magnetic flux leakage are reduced. For this reason, it is also possible to reduce adverse influences on the unit in which this electromagnetic apparatus is mounted.

Embodiment 1

Figure 14:
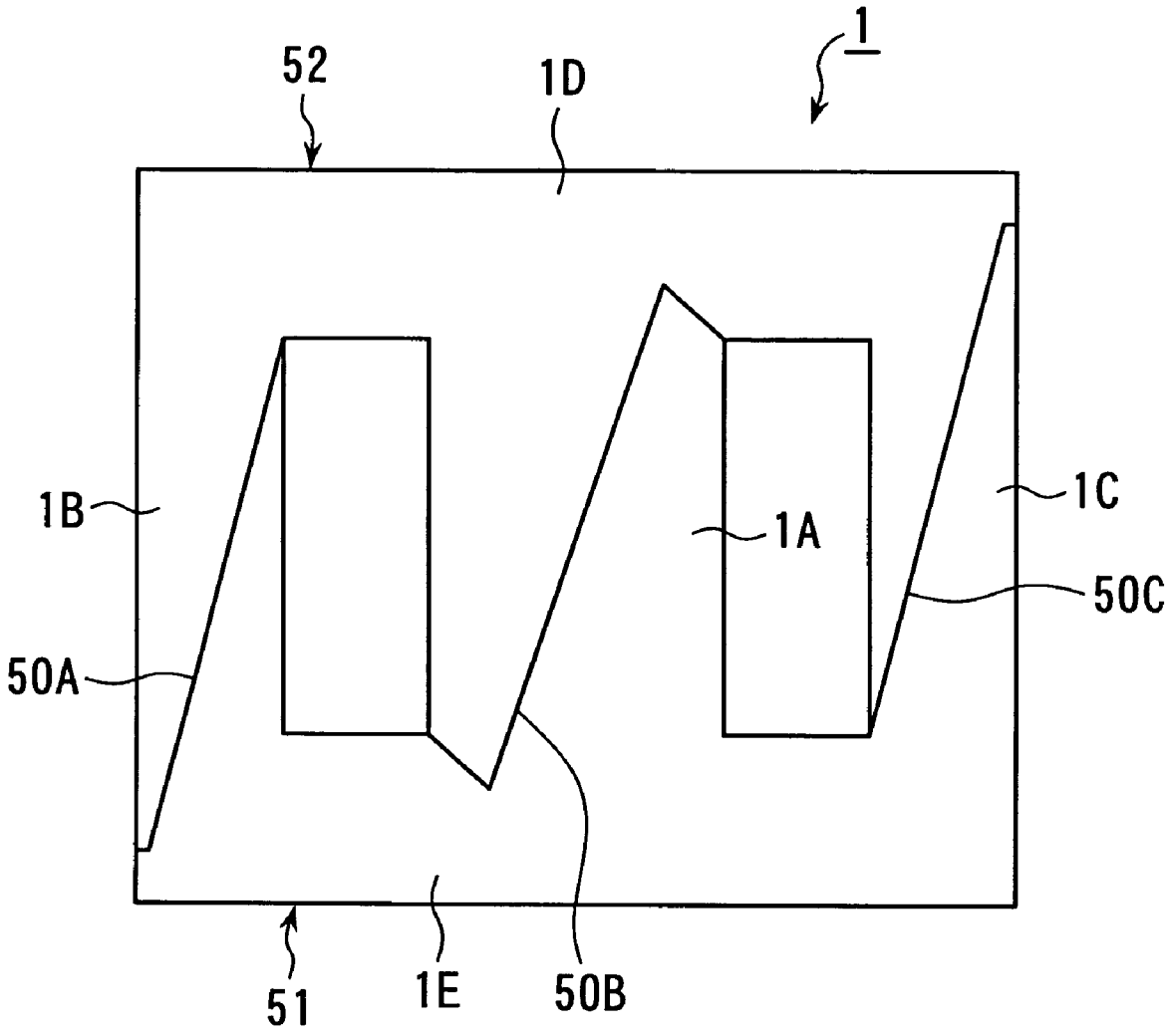
FIG. 14 is a plan view showing a magnetic core for an electromagnetic apparatus according to Embodiment 1.

FIG. 14 shows a magnetic core for an electromagnetic apparatus according to this embodiment. This embodiment will be explained below using both FIG. 14 and FIG. 2. The first outer leg section 1B side of the magnetic core for an electromagnetic apparatus 1 in FIG. 14 is cut obliquely from the corner $1F_1$ of the first opening 1F to the inside of the second link section 1E and the end of the cut is bent in the longitudinal direction of the second link section 1E. In this way, an at least partially inclined abutting section 50A is formed.

Furthermore, in the magnetic core for an electromagnetic apparatus in FIG. 14, the middle leg section 1A is cut obliquely by an inclined rectilinear section which extends from the inside of the first link section 1D to the inside of the second link section 1E. Further, the first link section 1D is cut by a rectilinear line which makes an acute angle with the rectilinear section at one end of the rectilinear section and which extends obliquely from that end to the corner $1G_1$ of the second opening 1G. Also, the second link section 1E is cut by another rectilinear line which makes an acute angle with the rectilinear section at the other end of the rectilinear section and which extends obliquely from the other end to the corner $1F_2$ of the first opening 1F. That is, in the magnetic core for an electromagnetic apparatus in FIG. 14, the middle leg section 1A together with the first link section 1D and the second link section 1E is cut by a zigzag abutting section 50B.

Furthermore, the second outer leg section 1C of the magnetic core for an electromagnetic apparatus in FIG. 14 is cut obliquely from the corner $1G_2$ of the second opening 1G to the inside of the first link section 1D and the end of the cut is bent in the longitudinal direction of the first link section 1D. That is, in the magnetic core for an electromagnetic apparatus in FIG. 14, the second outer leg section 1C together with the first link section 1D is cut by an at least partially inclined abutting section 50C.

Figure 15:
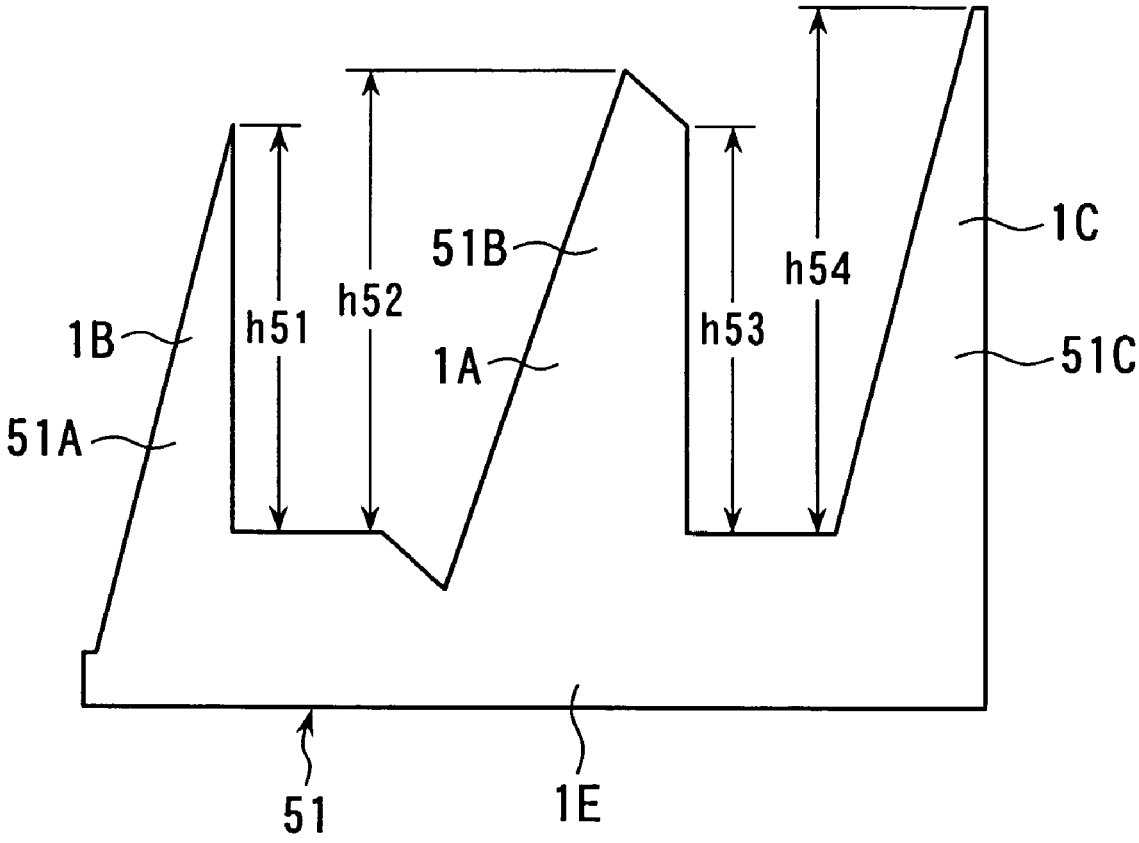
FIG. 15 is a plan view showing a substantially E-shaped core according to Embodiment 1.

As shown above, the magnetic core for an electromagnetic apparatus is formed of substantially E-shaped cores 51, 52 located respectively on each side of the abutting section 50A and the abutting section 50C which are at least partially inclined, and the zigzag abutting section 50B. As shown in FIG. 15, the substantially E-shaped core 51 is provided with protrusions 51A to 51C, all parts of which are tapering. The protrusion 51A corresponds to a part of the first outer leg section 1B and the length h51 thereof is same with the length b1 of the first opening 1F. The overall length h52 of the protrusion 51B at the middle is longer than the length b1 of the second opening 1G and the end of the protrusion 51B extends into the width a1 of the first link section 1D. Further, the length h53 of the rectilinear section perpendicular to the longitudinal direction of the second link section 1E of the protrusion 51B at the middle is same with the length b1 of the second opening 1G The overall length h54 of the protrusion 51C on the second outer leg section 1C side is longer than the length b1 of the second opening 1G and the end of the protrusion 51C extends into the width a1 of the first link section 1D.

Furthermore, in this embodiment, the zigzag abutting section 50B and the at least partially inclined abutting sections 50A and 50C are provided in such a way that the substantially E-shaped core 52 and the substantially E-shaped core 51 making up the magnetic core for an electromagnetic apparatus 1 have the same shape.

This Embodiment 1 can drastically improve the characteristics of the magnetic core for an electromagnetic apparatus, with all sections of the abutting section of the middle leg and at least parts of the respective abutting sections of the outer legs being inclined. Furthermore, this embodiment adopts the substantially E-shaped core 51 and the substantially E-shaped core 52 of the same shape, and can thereby reduce the number of parts used to manufacture the magnetic core for an electromagnetic apparatus.

Embodiments of the present invention have been described in details so far, but the specific structure thereof is not limited to those embodiments and any design modifications, and so on, which do not depart from the essence of the present invention is also included in the present invention. For example, in the foregoing embodiments the magnetic core for an electromagnetic apparatus 1 is formed of two cores of a same shape, but the effects similar to those in Embodiment 1 can be obtained even when the magnetic core for an electromagnetic apparatus is formed of two cores of different shapes.

What is claimed is:

1. A magnetic core for an electromagnetic apparatus, having a middle leg section, having a first outer leg section and a second outer leg section which are arranged on each side of the middle leg section, having a first link section and a second link section respectively linking each side of the middle leg section, the first outer leg section and the second outer leg section, and having a first opening and a second opening located between the respective leg sections, the magnetic core comprising;

two cores which are joined with each other with a first abutting section extending through the middle leg section to insides of the first and second link sections, a second abutting section extending through the first outer leg section, and a third abutting section extending through the second outer leg section, wherein the first abutting section consists mainly of a first rectilinear section extending obliquely from the inside of the first link section to the inside of the second link section, a second rectilinear section extending obliquely from one end of the first rectilinear section and up to the first opening, and a third rectilinear section extending obliquely from an other end of the first rectilinear section and up to the second opening.

2. The magnetic core for an electromagnetic apparatus according to claim 1 characterized in that the second abutting section extends outwardly and obliquely from a corner on the first link section side as well as on an outer side of the first opening and to an inside of the second link section, with an end part extending in a longitudinal direction of the second link section, while the third abutting section extends outwardly and obliquely from a corner on the second link section side as well as on an outer side of the second opening and to an inside of the first link section, with an end part extending in a longitudinal direction of the first link section.

3. The magnetic core for an electromagnetic apparatus according to claim 1 characterized in that the two cores, which are on each side of the first abutting section, the second abutting section and the third abutting section, have a same shape.

4. The magnetic core for an electromagnetic apparatus according to claim 2 characterized in that the two cores, which are on each side of the first abutting section, the second abutting section and the third abutting section, have a same shape.

5. An electromagnetic apparatus comprising a magnetic core for an electromagnetic apparatus having a middle leg section, having a first outer leg section and a second outer leg section which are arranged on each side of the middle leg section, having a first link section and a second link section respectively linking each side of the middle leg section, the first outer leg section and the second outer leg section, and having a first opening and a second opening located between the respective leg sections, the magnetic core comprising;

two cores which are joined with each other with a first abutting section extending through the middle leg section to insides of the first and second link sections, a second abutting section extending through the first outer leg section, and a third abutting section extending through the second outer leg section, wherein the first abutting section consists mainly of a first rectilinear section extending obliquely from the inside of the first link section to the inside of the second link section, a second rectilinear section extending obliquely from one end of the first rectilinear section and up to the first opening, and a third rectilinear section extending obliquely from an other end of the first rectilinear section and up to the second opening.

6. The electromagnetic apparatus according to claim 5 characterized in that the second abutting section extends outwardly and obliquely from a corner on the first link section side as well as on an outer side of the first opening and to an inside of the second link section, with an end part extending in a longitudinal direction of the second link section, while the third abutting section extends outwardly and obliquely from a corner on the second link section side as well as on an outer side of the second opening and to an inside of the first link section, with an end part extending in a longitudinal direction of the first link section.

7. The electromagnetic apparatus according to claim 5 characterized in that the two cores, which are on each side of the first abutting section, the second abutting section and the third abutting section, have a same shape.

8. The electromagnetic apparatus according to claim 6 characterized in that the two cores, which are on each side of the first abutting section, the second abutting section and the third abutting section, have a same shape.

* * * * *